US005693386A

United States Patent [19]

Cheng

[11] Patent Number: 5,693,386

[45] Date of Patent: Dec. 2, 1997

[54] DECORATIVE GIFT ARTICLE

[76] Inventor: Kui-Eng Cheng, 99 Glencairn Street, Toronto, Ontario, Canada, M4R 1M7

[21] Appl. No.: 437,835

[22] Filed: May 9, 1995

[51] Int. Cl.[6] ..... B65D 30/22; B65D 33/06

[52] U.S. Cl. ..... 428/35.2; 428/36.1; 428/36.8; 428/24; 428/27; 383/71; 383/107; 383/109; 383/117; 383/123; 426/106; 426/108; 206/423; 47/41.01

[58] Field of Search ..... 428/35.2, 35.5, 428/36.1, 34.3, 24, 27, 36.8; 383/117, 71, 72, 73, 74, 76, 109, 107, 123; 206/457, 443, 575, 423, 756, 763, 769, 490; 426/108, 106, 660; 47/41.01

[56] References Cited

U.S. PATENT DOCUMENTS

| | | | |
|---|---|---|---|
| 3,861,581 | 1/1975 | Sellors | 229/104 |
| 5,020,672 | 6/1991 | Watts | 206/575 |
| 5,031,759 | 7/1991 | Ogilvie | 383/117 |
| 5,551,570 | 9/1996 | Shaffer et al. | 206/575 |

*Primary Examiner*—Rena Dye
*Attorney, Agent, or Firm*—Kirschstein et al.

[57] ABSTRACT

A decorative gift article includes at least one, but preferably more than one, gift item, and a support of a predetermined countenance that is to be used for presenting the gift item or items. A retaining frame secured to the support serves to retain the gift items at a top face of the support so as to be at least partly visible. The retaining frame has at least one mounting portion secured to the support and a loop-shaped portion integral with the mounting portion and delimiting an opening for the passage of the gift item therethrough. The opening has at least one dimension smaller than a corresponding dimension of the gift item and the loop-shaped portion is capable of yielding out of the path of movement of the gift item during intentional withdrawal of the latter through the opening. The loop-shaped portion includes a transitional section merging with the mounting portion and extending along an arcuate course to permit access to the gift item for engaging the same from behind when it is desired to extract the same through the opening. A pouch is mounted on the loop-shaped portion and assumes a substantially trough-shaped configuration when the item is accommodated therein. The pouch has a substantially sleeve-shaped configuration that is doubled up and trained about the loop-shaped portion of the retaining frame. The retaining frame extends radially outwardly from a center of the top face of the support.

10 Claims, 1 Drawing Sheet

DECORATIVE GIFT ARTICLE

BACKGROUND OF THE INVENTION

1. Field of the Invention

The present invention relates to items to be given as presents in general, and more particularly to arrangements for holding such gift items in a manner that enhances their aesthetic appeal especially as they are being presented.

2. Description of the Related Art

It is a well-established custom in many areas of the world to give certain items as tokens of admiration, esteem, recognition or the like. Such items may range from those which have considerably more than just a token value, such as jewelry, all the way to relatively inexpensive ones, such those of the edible variety, including chocolate or hard candy, other sweets or the like. Other popular items frequently given as presents are natural flowers, ranging from a single rose through a bunch of violets all the way to sometimes quite elaborate flower arrangements.

Moreover, it has also been attempted since time immemorial to take certain measures intended to contribute to or enhance the visual attractiveness of the items being presented. So, for instance, flowers may be wrapped in decorative wrapping paper, chocolate candy may be presented in boxes that may themselves be decorative and/or be wrapped in decorative wrapping paper, etc.

Yet, all such previously known gift ideas have a common disadvantage: as welcome as the present may be when received, it immediately raises a question what to do with it, especially when given on a date. Of course, a box of chocolates can be opened, its contents eaten on the spot, and the box discarded; not too many people do that, though, so that the box is carried around until the recipient finally gets home.

The latter fate befalls flowers as well, inasmuch as it would be at least impolite if not outright rude or insulting to discard them within the eyesight of the gift giver. By then, though, they will probably be wilted beyond recovery so that discarding them will be the only option left. While the problem of wilting would not be present if artificial flowers were given instead of real ones, this is usually not an acceptable alternative; moreover, they would still have to be carried around, thus presenting a possibly appreciated but still at least a slight nuisance.

OBJECTS OF THE INVENTION

Accordingly, it is a general object of the present invention to avoid the disadvantages of the prior art.

More particularly, it is an object of the present invention to provide a decorative article to be given as a gift, which article does not possess the drawbacks of the known articles of this type.

Still another object of the present invention is to devise a decorative article of the type here under consideration which can be easily placed on a convenient location of the body, garments or accessories of the recipient so as not to interfere with the recipient's activities.

It is yet another object of the present invention to design the above article in such a manner as to make it appealing to the recipient.

A concomitant object of the present invention is so to construct the article of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a decorative gift article which includes at least one gift item, and means for presenting the gift item. According to the invention, the presenting means includes a support of a decorative countenance having top and bottom faces, and means for retaining the gift item on the support at the top face thereof so as to be at least partly visible thereat.

This particular construction of the decorative gift article has the particular advantage that it renders it possible to present the gift items in question, such as candy, in a practical yet tasteful manner. More particularly, the practical aspect can be found in the compact configuration of the support which renders it possible to easily find a place at a location associated with the recipient for joint movement where to keep the article until a more permanent location can be found, without inconveniencing or interfering with any activities of the recipient. On the other hand, the tastefulness resides in the aesthetically pleasing appearance of the support and in a commensurately attractive arrangement of the gift item at the top face of the support.

It is particularly advantageous when, in accordance with the invention, the retaining means includes a retaining frame having at least one mounting portion secured to the support and a loop-shaped portion integral with the mounting portion and delimiting an opening for the passage of the gift item therethrough, and when the opening has at least one dimension smaller than a corresponding dimension of the gift item and the loop-shaped portion being capable of yielding out of the path of movement of the gift item during intentional withdrawal of the latter through the opening. In this connection, it is especially advantageous when the loop-shaped portion of the retaining frame includes a transitional section merging with the mounting portion and extending along an arcuate course to permit access to the gift item for engaging the same from behind when it is desired to extract the same through the opening.

According to a further advantageous facet of the present invention, the retaining means further includes a pouch mounted on at least the loop-shaped portion of the retaining frame and assuming a substantially trough-shaped configuration when the item is accommodated therein. Advantageously, the pouch has a substantially sleeve-shaped configuration that is doubled up and trained about the loop-shaped portion of the retaining frame. It is particularly advantageous when the pouch is of a mesh-like material.

An especially advantageous construction and appearance of the decorative gift article is obtained when there is provided more than one gift item with all such items being similar to or even identical with one another, and when the presenting means includes separate and spaced retaining means for retaining the gift items at locations of the top face that are spaced from one another. In this context, it is especially favorable when the separate retaining means associated with the respective gift items extend radially outwardly from a center of the top face in the manner of flower petals.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying

DETAILED DESCRIPTION OF THE PREFERRED EMBODIMENT

Figure 1:
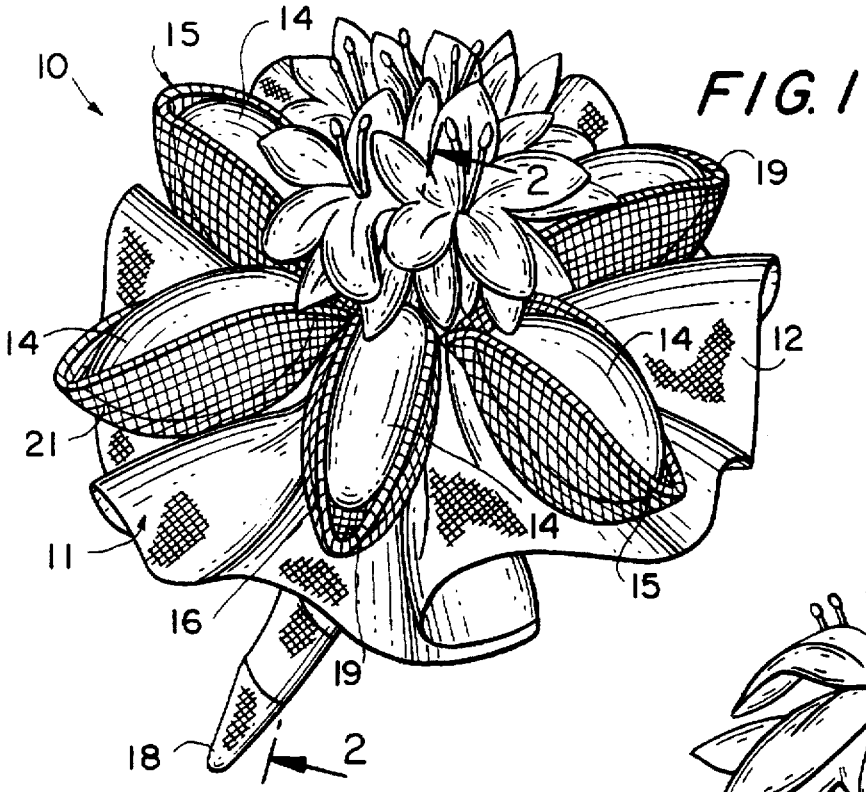
FIG. 1 is a perspective view of a decorative article of the present invention.

Referring now to the drawing in detail, and first to FIG. 1 thereof, it may be seen that the reference numeral 10 has been used therein to identify a decorative article of the present invention in its entirety. The decorative article 10 includes a support member 11 that has a predetermined shape, look, texture, appearance, aesthetic appeal, and/or feel (which are referred to herein individually or in combination as "countenance") and is made from well-known materials currently used in the fabrication of artificial or so-called silk flowers using methods well known in that art or industry. The precise configuration of the support member 11 of the decorative article 10 is of little consequence in the context of the present invention, so long it is presentable and aesthetically pleasing. As shown, the support member has the countenance of a flower, but can equally well be shaped as any three-dimensional object such as a bird, swan, or clown.

In accordance with the present invention, the support member 11, which has a top side or face 12 and a bottom side or face 13, is intended to be given as a present to a person who is adored, esteemed, revered and/or loved by the original owner or purchaser of the article 10, but not alone. Rather, it is to be embellished, enhanced or otherwise improved by at least one gift item 14, but preferably a plurality of such gift items 14, such as a piece or pieces of foil-wrapped, otherwise wrapped, or even unwrapped hard, soft or even chocolate candy, that is or are held or retained in position on the flower-like support 11, thus to form an additional component or additional components of the article 10.

Figure 2:
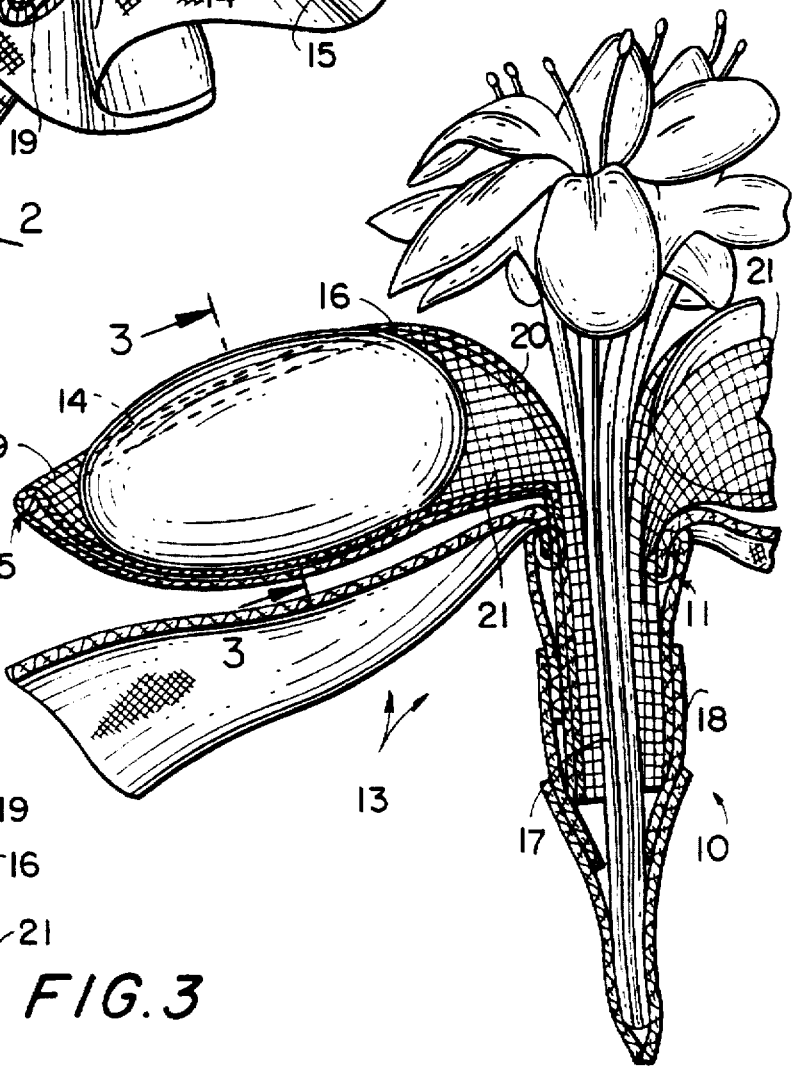
FIG. 2 is a sectional view at an enlarged scale taken on line 2—2 of FIG. 1 through a part of the decorative article.

To this end, the support 11 has incorporated therein and/or connected thereto a retaining frame 15 for each of the items 14 to be held on the support 11. The respective retaining frame 15 has a loop-shaped resilient portion 16 that is situated above the top face 12 of the flower-like support 11 and extends substantially radially from a central region to a peripheral region of the support 11, and a substantially axially extending mounting portion or portions 17 integral with the loop-shaped portion 16 and secured to the support 11 primarily at the bottom face thereof, especially within an axially extending bottom extension 18 of the support 11 that has a configuration and appearance resembling a flower stem and/or pedicel and will ordinarily be used by the presenter or recipient as a handle for holding and supporting the article 10 upright. At this juncture, it is to be mentioned that all references contained herein with respect to various directions and relative positions, such as "up" or "down", "upper" or "lower", "top" or "bottom" are intended, and thus should be perceived, as relating to the orientation of the decorative article 10 that is depicted in the drawings, whereas all references to "central", "radial", "axial", or "circumferential" are similarly related to an axis of the support 11 about which the support is symmetrical or quasi-symmetrical, that is, a vertically extending axis passing substantially through the middle of the support 11 in the orientation illustrated in FIG. 2.

The respective loop-shaped portion 16 of the retaining frame 15 is positioned and configured in such a manner as to hold the item 14 securely in place in confinement between itself and the top face 12 of the support 11 against unintended dissociation from the support 11, yet to permit at least a substantial portion of the respective item 14 to be seen when looking at the top face 12 of the support 11. To achieve this result, at least the loop-shaped portion 16 of the retaining frame 15, but preferably the entire retaining frame 15, is made of a material that is elastically or plastically yieldable or flexible, i.e. a material that can be deformed and either remain deformed or return to its original shape when the deforming forces or influences are discontinued. Currently, it is preferred to make the retaining frame 15 of a resilient metallic wire material, but other metallic and non-metallic, especially synthetic plastic, materials could profitably be used instead, if so desired.

Figure 3:
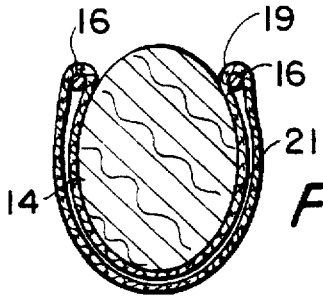
FIG. 3 is a cross-sectional view taken on line 3—3 of FIG. 2 through a part of the decorative article and omitting other parts that would appear only in the background.

In any event, the loop-shaped portion 16 of the retaining frame 15, in its original or undeformed condition, bounds an opening or mouth 19 having at least one dimension (as shown especially in FIG. 3, the width) smaller than the corresponding dimension of the gift item 14. As a result, when it is desired to remove the respective item 14 through the mouth 19, it is necessary to make the affected (lateral) regions of the loop-shaped portion 16 of the frame 15 yield out of the way of such movement of the item 14; hence the flexibility of the frame 15. As shown especially in FIG. 2 of the drawing, the loop-shaped portion 16 of the frame 15 has a transitional section 20 (one at each side of the item 14) that merges with the associated mounting portion 17 and extends along an arcuate course. The presence of this transitional section 20 renders it possible for a person wishing to take the particular item 14 out to engage such item 14 from behind and exert thereon a removal force directed radially outwardly and/or upwardly, causing the item 14 to push the lateral regions of the loop-shaped portion 16 of the frame apart until it completely passes through the mouth 19.

While it would be at least theoretically possible for the loop-shaped portion 16 of the retaining frame 15 to retain the respective item 14 in position by merely confining it between itself and the top face or side 12 of the support 11, especially if such top side 12 were strong enough or reinforced not to yield and thus let the item 14 fall through the gap existing between itself and the loop-shaped portion 16 of the retaining frame 15, it is currently preferred to provide a respective pouch 21 for this confinement purpose. The pouch 21 is mounted on the retaining frame 15 in a manner that is clearly visible in FIG. 3 of the drawing, that is, by having a substantially sleeve-shaped configuration that is doubled up and trained about at least the loop-shaped portion 16 of the frame 15. The pouch 21 assumes a trough-shaped configuration at least when the item 14 is accommodated therein, and is dimensioned to hold the item 14 in position with respect to the loop-shaped portion 16 of the frame with only a minimum amount of leeway, if any. In this manner, it is assured that the item or items 14 will not rattle against its frame or their frames 15 and/or against one another when the article 10 is being transported or transferred, which could be a rather disturbing occurrence. The pouch 21 is advantageously of a mesh-like material or netting, be it of textile fibers or yarns, or of synthetic plastic material.

It may be seen, especially when observing FIG. 1 of the drawing, that the items 14 and the components 15 and 21 that confine them are integrated with or organically blended into the remainder of the flower-like support 11 so that they are not considered to be disruptive. Quite to the contrary, such confining components 15 and 21, either by themselves or together with the associated items 14, give the impressions of petals of the flower-shaped support 11, thus enhancing the aesthetic appeal of the decorative article 10.

It will be understood that each of the elements described above, or two or more together, may also find a useful application in other types of constructions differing from the type described above.

While the present invention has been described and illustrated herein as embodied in a specific construction of a decorative gift article, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is desired to be protected by Letters Patent is set forth in the appended claims.

I claim:

1. A decorative gift article, comprising:

a) at least one gift item; and b) means for presenting said gift item, including a decorative support having top and bottom faces and an elongated handle for supporting the article upright, and means for retaining said gift item on said support at said top face thereof, said retaining means including a retaining frame having a mounting frame portion secured to said support and extending lengthwise along said handle, a radial frame portion extending radially outwardly from said handle to a peripheral region of said support and delimiting an opening for the passage of said gift item therethrough, and a pouch mounted on said radial frame portion for accommodating said gift item, said gift item being held in position by said radial frame portion and being visible through said opening.

2. The decorative gift article as defined in claim 1, wherein said radial frame portion is integral with said mounting frame portion.

3. The decorative gift article as defined in claim 1, wherein said opening has a width smaller than a corresponding width of said gift item, and wherein said radial frame portion is capable of yielding out of the path of movement of said gift item during intentional withdrawal of the latter through said opening.

4. The decorative gift article as defined in claim 1, wherein said gift item extends outwardly of said opening.

5. The decorative gift article as defined in claim 3, wherein said retaining frame includes a transitional section extending along an arcuate course between said mounting frame portion and said radial frame portion to permit access to said gift item for engaging the same from behind when it is desired to extract said gift item through said opening.

6. The decorative gift article as defined in claim 1, wherein said retaining frame includes additional radial frame portions angularly spaced from said radial frame portion about said handle; and further comprising additional pouches each mounted on a respective additional radial frame portion, and additional gift items accommodated in said additional pouches.

7. The decorative gift article as defined in claim 1, wherein said retaining frame is made of an elastically yieldable material.

8. The decorative gift article as defined in claim 1, wherein said pouch is made of flexible netting.

9. The decorative gift article as defined in claim 1, wherein said pouch has a double wall.

10. The decorative gift article as defined in claim 1, wherein said gift item is an edible confection.

* * * * *